US005837102A

United States Patent [19]

Graf

[11] Patent Number: 5,837,102

[45] Date of Patent: Nov. 17, 1998

[54] PERFORATED AND EMBOSSED SHEET FORMING FABRIC

[75] Inventor: Edwin X. Graf, Menasha, Wis.

[73] Assignee: Voith Sulzer Paper Technology North America, Inc., Appleton, Wis.

[21] Appl. No.: 41,486

[22] Filed: Mar. 12, 1998

Related U.S. Application Data

[63] Continuation-in-part of Ser. No. 847,564, Apr. 24, 1997, abandoned.

[51] Int. Cl.[6] ..... D21F 1/10

[52] U.S. Cl. ..... 162/296; 162/348; 162/903

[58] Field of Search ..... 162/348, 903, 162/296; 428/131

[56] References Cited

U.S. PATENT DOCUMENTS

| | | | |
|---|---|---|---|
| 1,925,917 | 9/1933 | Chalon | 162/900 |
| 3,121,660 | 2/1964 | Hall, Jr. | 112/903 |
| 3,399,111 | 8/1968 | Beaumont et al. | 162/349 |
| 4,162,190 | 7/1979 | Ashworth | 162/900 |
| 4,541,895 | 9/1985 | Albert | 162/903 |
| 4,931,010 | 6/1990 | Barnewall | 162/900 |
| 5,298,124 | 3/1994 | Eklund et al. | 162/358.2 |

FOREIGN PATENT DOCUMENTS

| | | | |
|---|---|---|---|
| 1295197 | 4/1962 | France | 162/903 |

*Primary Examiner*—Karen M. Hastings
*Attorney, Agent, or Firm*—Taylor & Associates, P.C.

[57] ABSTRACT

A paper-making machine for forming a paper web from a fiber suspension includes rotatable rolls, an endless forming fabric, and a headbox configured to receive and discharge the fiber suspension. The endless forming fabric is carried by the rolls and is configured to directly carry the fiber suspension discharged by the headbox. The forming fabric includes a monolithic plastic sheet with water drainage holes therein. The sheet has an embossed outer surface with generally rounded projections and generally rounded depressions. Each of the projections has a height of at least 125 microns. The embossed outer surface is configured for contacting the fiber suspension. The embossed outer surface of the sheet is formed using a calender having at least one embossing roll.

12 Claims, 5 Drawing Sheets

PERFORATED AND EMBOSSED SHEET FORMING FABRIC

Cross Reference to Related Applications

This is a continuation-in-part of U.S. patent application Ser. No. 08/847,564, entitled "PERFORATED SHEET FORMING FABRIC AND METHOD OF MANUFACTURING THE SAME," filed Apr. 24, 1997 now abandoned.

BACKGROUND OF THE INVENTION

1. Field of the Invention

The present invention relates to paper-making machines, and more particularly, to forming fabrics used in paper-making machines.

2. Description of the Related Art

A paper-making machine typically includes a forming section at the wet end thereof. The forming section usually includes one or more forming fabrics which carry the fiber suspension which is discharged from a headbox. The forming fabric is in the form of a woven polymeric material (see FIGS. 1 and 2). More particularly, a plurality of polymeric strands with a known diameter are woven together to define a forming fabric with a plurality of mesh openings between the strands. Suction and sometimes positive pressure are usually applied to the forming fabric on the side opposite the fiber suspension to pull and thereby remove water from the fiber suspension. Different weave patterns resulting in different mesh openings may be utilized, depending upon the application. However, the weaving process is relatively time consuming which adds to the cost of the forming fabric.

It is also known to use, as a fourdrinier wire in the wet end of a paper-making machine, a flat, smooth sheet of material having a pattern of perforations therethrough. The perforations are formed with a punching die, which creates sharp burrs at the edges of the perforations on the surface of the sheet. The sharp burrs, which would otherwise damage the wet fiber suspension, are completely ground off so that the surface of the sheet is smooth and free from projections. A problem with a sheet having such a smooth surface is that the wet fiber suspension tends to adhere thereto and does not easily release and transfer to the next section of the paper-making machine. Because of the adhesion, the fiber suspension can be damaged during its release from the wire.

It is further known to provide a transfer belt in the dry end of a paper-making machine with a coating having sharp peaks and valleys. The sharp peaks and valleys create an overall roughness on the surface of the transfer belt, which roughness improves the release properties of the transfer belt in transferring a paper sheet to the next section of the paper-making machine. Although such sharp peaks and valleys may be suitable in a dryer section for supporting a substantially dry paper sheet, the fibers of which have relatively strong mutual adhesion, such sharp peaks would cut into and damage a wet fiber suspension on the wet end of a paper-making machine, the fibers of which have relatively weak mutual adhesion. In addition to cutting into and damaging the fiber suspension, the sharp peaks would snag or hook the fiber suspension upon transfer to the next section of the paper-making machine, resulting in poor release properties. It is not possible to form such sharp peaks and valleys using an embossing roll.

What is needed in the art is a forming fabric that is less costly and less time consuming to manufacture, has good release properties, and does not damage the fiber suspension.

SUMMARY OF THE INVENTION

The present invention provides a forming fabric including an embossed sheet having a plurality of holes made therein.

The invention comprises, in one form thereof, a paper-making machine for forming a paper web from a fiber suspension. The paper-making machine includes rotatable rolls, an endless forming fabric, and a headbox configured to receive and discharge the fiber suspension. The endless forming fabric is carried by the rolls and is configured to directly carry the fiber suspension discharged by the headbox. The forming fabric includes a monolithic plastic sheet with water drainage holes therein. The sheet has an embossed outer surface with generally rounded projections and generally rounded depressions. Each of the projections has a height of at least 125 microns. The embossed outer surface is configured for contacting the fiber suspension. The embossed outer surface of the sheet is formed using a calender having at least one embossing roll.

An advantage of the present invention is the shorter time required to manufacture the forming fabric, resulting in a lower manufacturing cost.

Another advantage is that the pattern or configuration of the holes can be easily changed from one forming fabric to another forming fabric.

Yet another advantage is that the rounded projections and depressions on the surface of the sheet do not damage the fiber suspension, yet provide good release properties therefrom.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrate one preferred embodiment of the invention, in one form, and such exemplification is not to be construed as limiting the scope of the invention in any manner.

DETAILED DESCRIPTION OF THE INVENTION

Figure 1:
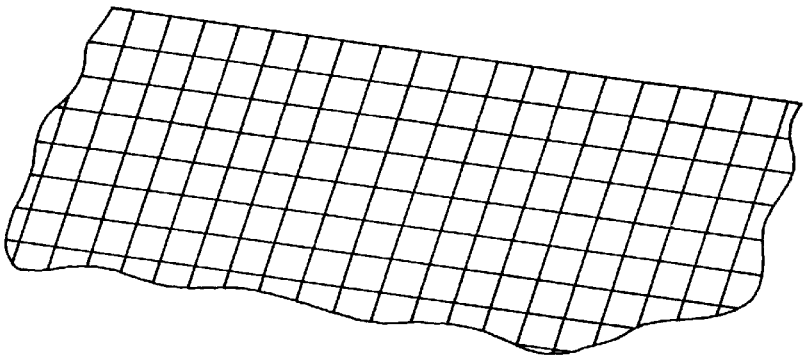
PRIOR ART Fig. 1
FIG. 1 is a fragmentary, perspective view of a conventional woven forming fabric.
Figure 2:
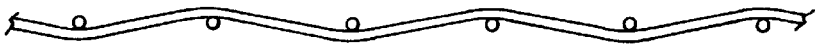
PRIOR ART Fig. 2
FIG. 2 is a fragmentary, side sectional view of the conventional woven forming fabric of FIG. 1.
Figure 3:
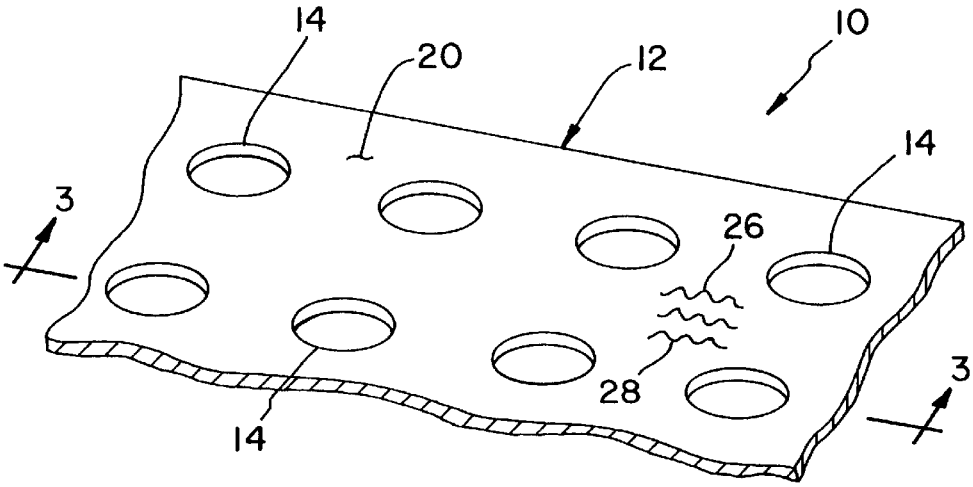
FIG. 3 is a perspective view of one embodiment of a perforated sheet forming fabric of the present invention.
Figure 4:
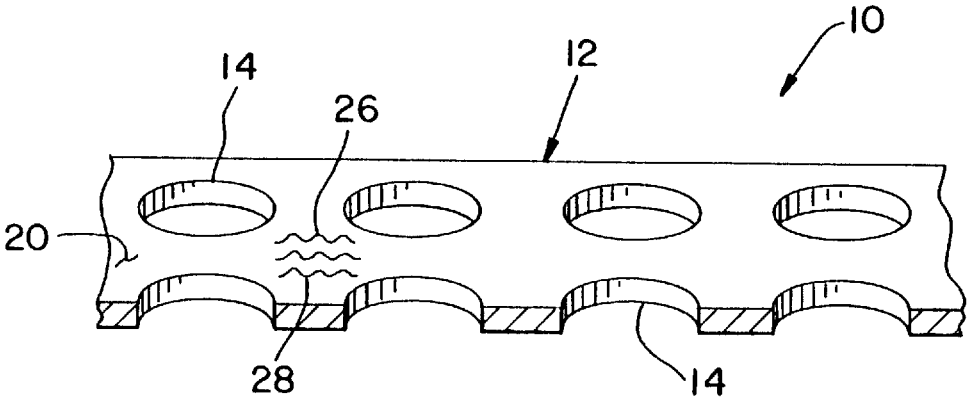
FIG. 4 is a perspective sectional view of the perforated sheet forming fabric of FIG. 3, taken along line 3—3.

Referring now to the drawings and particularly to FIGS. 3 and 4, there is shown a perforated sheet forming fabric 10 including a sheet 12 having holes 14. Forming fabric 10 is used in a machine for manufacturing a fiber web such as a paper or cardboard web. Perforated sheet forming fabric 10 is preferably used in the forming section, such as a fourdrinier forming section, of a paper-making machine.

Sheet 12 is preferably fabricated from a hydrophilic or hydrophobic plastic material having a high resistance to chemicals and fatigue. In the embodiment shown in FIGS. 3 and 4 sheet 12 is fabricated from polyester film having a thickness of between approximately 0.005 and 0.050 inch. Two opposite ends (not shown) of sheet 12 are joined or attached together so that forming fabric 10 can be rotated in an endless loop.

Sheet 12 includes a plurality of water drainage holes 14 extending therethrough (FIGS. 3 and 4). Holes 14, in the embodiment shown in FIGS. 3 and 4, are configured in a linear, parallel pattern. However, it is to be understood that holes 14 may be arranged in any pattern or with any spacing, depending upon the type and/or grade of paper to be made, etc. Moreover, in the embodiment shown, the dimension of each of holes 14 is maximally approximately 0.060 inch with a hole-to-hole spacing of between approximately 0.005 and 0.015 inch therebetween. Holes 14 are sized such that water can fall through holes 14 by force of gravity and/or be drawn therethrough using suction and/or positive pressure. Holes 14, in the embodiment shown in FIG. 3, are circular. However, it is to be understood that holes 14 may have any geometric shape.

Figure 5:
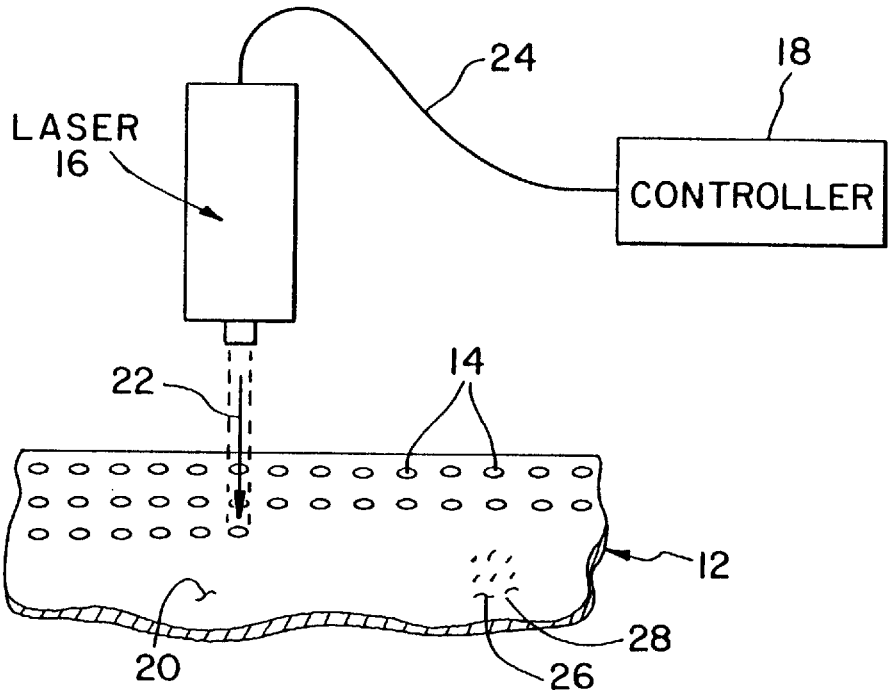
FIG. 5 is a perspective view of a laser used to cut holes during the process of manufacturing the forming fabric of the present invention.
Figure 7:
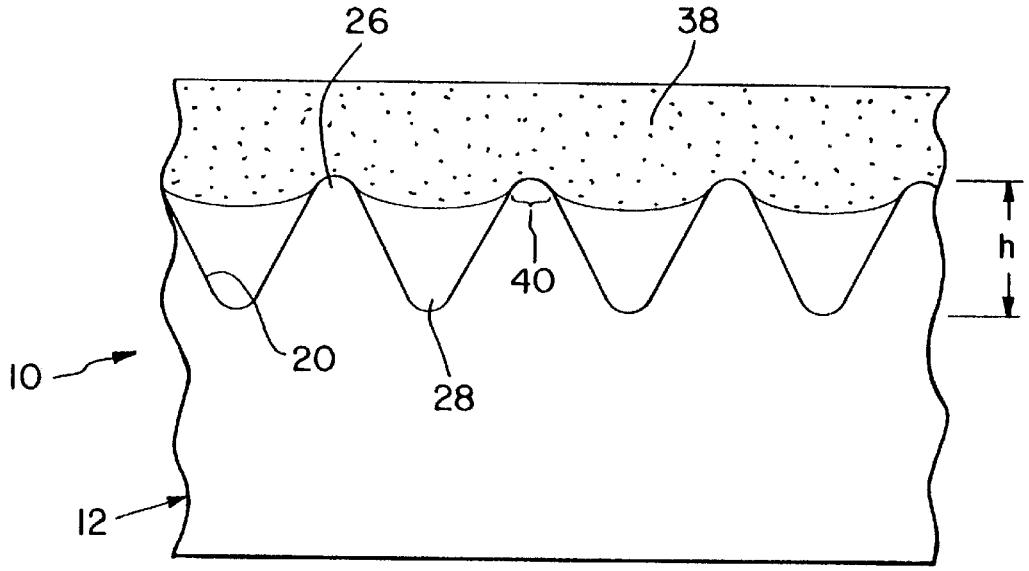
FIG. 7 is an enlarged, side view of the perforated sheet forming fabric of FIGS. 3 and 4 supporting a fiber suspension.
Figure 8:
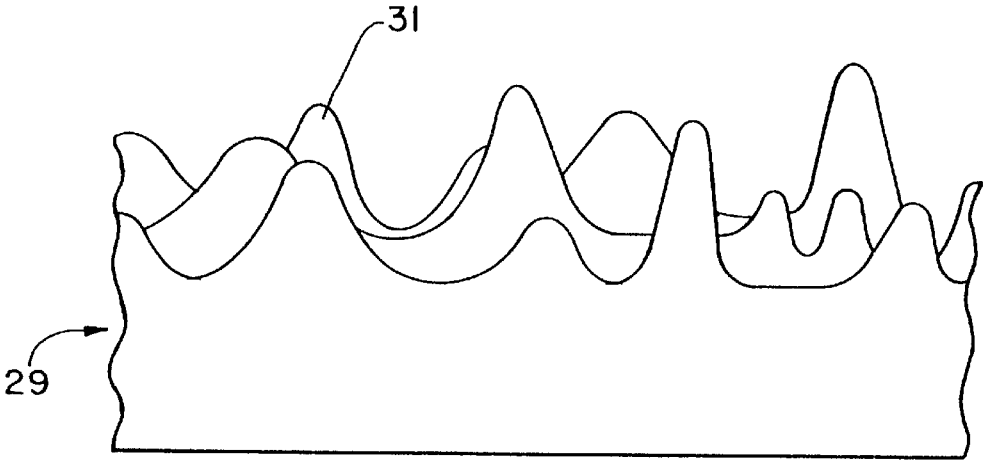
FIG. 8 is an enlarged, side view of another embodiment of a perforated sheet forming fabric of the present invention.

Surface 20 is embossed to provide a texturized surface with desired release properties from the fiber suspension layer carried thereby. Surface 20 includes generally rounded projections 26 and generally rounded depressions 28, only a small number of which are shown in FIGS. 3–5 for simplicity. Projections 26 have an average height h (FIG. 7) extending from the bottom of depressions 28 at the base of projections 26 to the top of projections 26. Height h measures at least 125 microns ($\mu$m; approximately 0.005 inch). Projections 26 and depressions 28 are shown in FIG. 7 as being substantially sinusoidal with even spacing therebetween and equal heights h. Another embodiment of a perforated sheet forming fabric 29 is shown in FIG. 8, however wherein projections 31 have various heights and various spacings therebetween to form a randomly undulating pattern with an average height of at least 125 microns.

Figure 6:
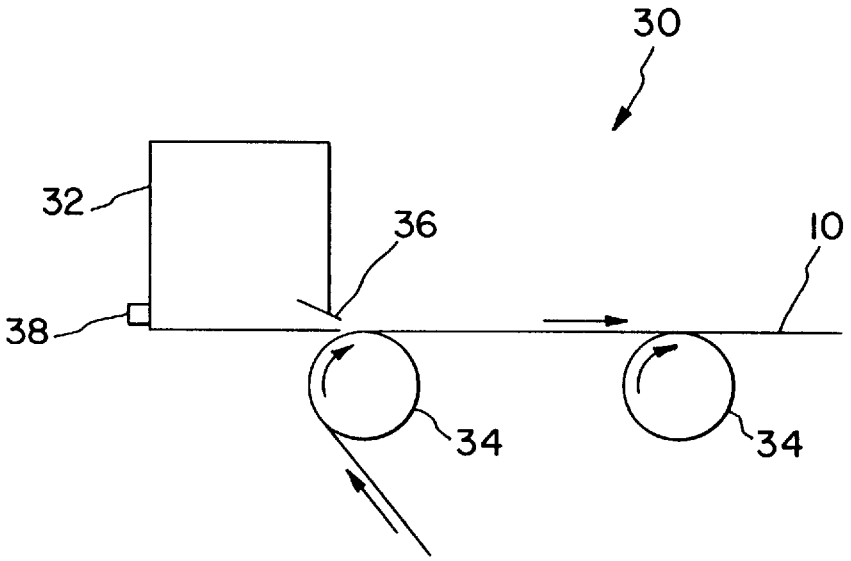
FIG. 6 is a schematic, side view showing the perforated sheet forming fabric of FIGS. 3 and 4 within a paper-making machine.

Referring now to FIG. 6, there is shown a schematic, side view of a portion of a paper-making machine 30 with the perforated sheet forming fabric 10 installed therein. Paper-making machine 30 includes a headbox 32 and a plurality of rotatable rolls 34. Headbox 32 is configured to receive the fiber suspension at an inlet 38 and discharge the fiber suspension from a nozzle-shaped outlet 36 onto perforated sheet forming fabric 10.

During use, a layer of fiber suspension 38 exiting headbox 32 is deposited onto perforated sheet forming fabric 10. Fiber suspension 38 is supported at a level above depressions 28 by projections 26 on forming fabric 10, as shown in FIG. 7. Projections 26 include an effective surface area 40 which contacts fiber suspension 38. Effective surface area 40 is generally rounded so that fabric 10 does not puncture or otherwise damage fiber suspension 38. Depressions 28 are also generally rounded to provide for easy cleaning of fabric 10 by allowing cleaning implements (not shown) to readily penetrate and contact the bottom of depressions 28.

Gravity and/or suction pulls water from the fiber suspension, through holes 14 and into a drain below (not shown). Perforated sheet forming fabric 10 is arranged in an endless loop to carry the pulp to the next step in the paper-making process and then rotate back around to receive more fiber suspension from the headbox. Projections 26 provide good release properties at the point in the endless loop where fiber suspension 38 is transferred from forming fabric 10 to the next section of the paper-making machine. Since fiber suspension 38 contacts only effective surface area 40, rather than the entire surface of a sheet forming fabric, there is less adhesion force between fiber suspension 38 and forming fabric 10. Consequently, fiber suspension 38 easily separates or releases from forming fabric 10 as fiber suspension 38 transfers to the next section of the paper-making machine. These superior release properties result in a greatly reduced chance of damage to fiber suspension 38 as it is transferred from forming fabric 10 to the next section of the paper-making machine.

Figure 9:
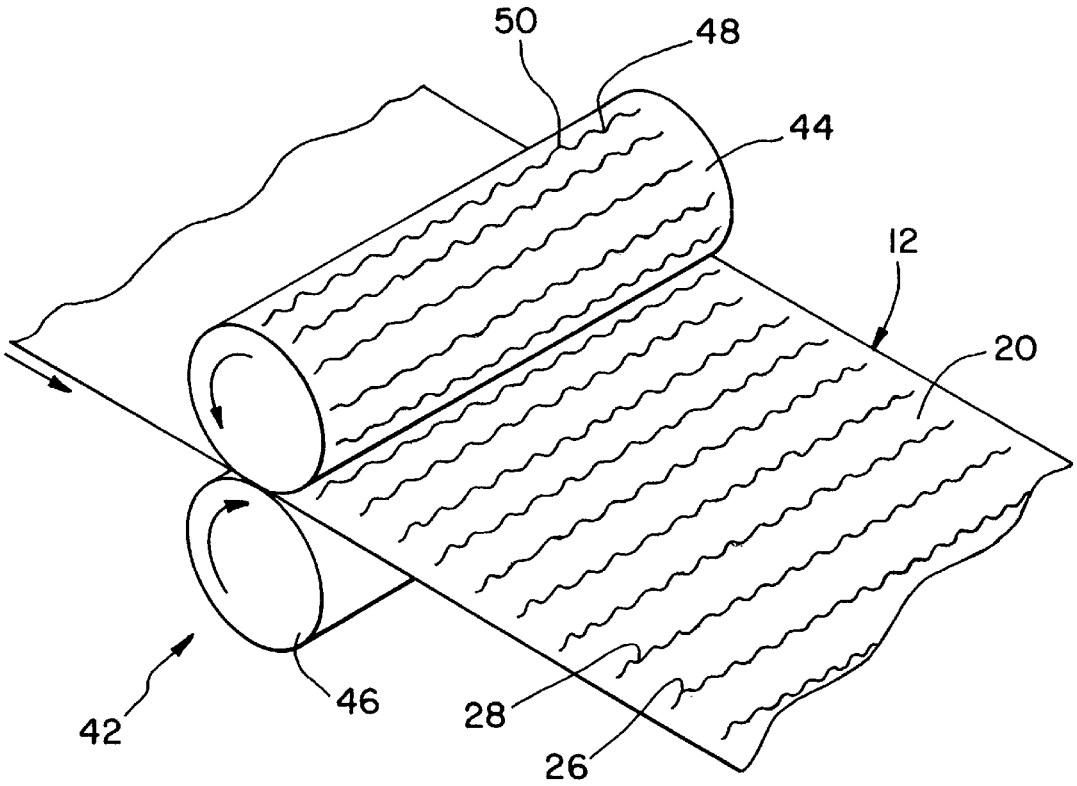
FIG. 9 is a perspective view of a calender stack including an embossing roll used to create projections and depressions during the process of manufacturing the forming fabric of the present invention.

During manufacture, the initially smooth and unperforated sheet 12 is run through a calender stack 42 (FIG. 9) including at least one embossing roll 44 and a backing roll 46. Embossing roll 44 has corresponding rounded depressions 48 and projections 50 which produce generally rounded projections 26 and depressions 28, respectively, on surface 20. Only a few of depressions 48, projections 50, depressions 28 and projections 26 are shown in FIG. 9 as greatly enlarged for simplicity. After embossing, laser 16 may be used to create holes 14 in sheet 12 quickly and cleanly (FIG. 5). Laser 16 provides a laser output 22 with a particular size and intensity which may be variable. An electronic controller 18 connected to laser 16 via conductor 24 may be programmed to direct laser 16 to cut holes 14 in any desired size, pattern, spacing or shape, or even randomly. It is also possible to emboss sheet 12 after holes 14 have already been formed. The two opposite ends of sheet 12 may be glued together to form an endless loop. Alternatively, the two opposite ends of sheets 12 may be ultrasonically or thermally welded together.

In the embodiment of perforated sheet forming fabric 10 described above, holes 14 are cut into sheet 12 using a controlled laser 16. However, it is also possible to cut holes 14 in sheet 12 using other known apparatus such as a controlled water-like cutter or the like.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A paper-making machine for forming a paper web from a fiber suspension, said paper-making machine comprising:

a headbox configured to receive and discharge the fiber suspension;

a plurality of rotatable rolls; and an endless forming fabric carried by said plurality of rolls and configured to directly carry the fiber suspension discharged by said headbox, said forming fabric comprised of a monolithic plastic sheet with a plurality of water drainage holes therein, said sheet having an embossed outer surface configured for contacting the fiber suspension, said outer surface having a plurality of generally rounded projections and a plurality of generally rounded depressions, said plurality of projections having an average height of at least 125 microns, said embossed outer surface of said sheet being formed using a calender having at least one embossing roll.

2. The paper-making machine of claim 1, wherein each of said projections has a height of approximately between 125 and 200 microns.

3. The paper-making machine of claim 1, wherein said generally rounded projections are configured to support the fiber suspension at a level above said generally rounded depressions.

4. The paper-making machine of claim 1, wherein said sheet has an effective surface area configured for contacting the fiber suspension, said generally rounded projections being configured to reduce said effective surface area.

5. The paper-making machine of claim 1, wherein said embossed outer surface has at least one of a sinusoidal pattern and randomly undulating pattern.

6. The paper-making machine of claim 1, wherein said sheet is comprised of hydrophilic plastic.

7. The paper-making machine of claim 1, wherein said sheet is comprised of hydrophobic plastic.

8. The paper-making machine of claim 1, wherein said sheet is comprised of polyester.

9. The paper-making machine of claim 1, wherein said holes have a diameter of maximally approximately 0.060 inch.

10. The paper-making machine of claim 1, wherein said holes have a spacing therebetween of between approximately 0.005 and 0.015 inch.

11. The paper-making machine of claim 1, wherein said sheet has a thickness of between approximately 0.005 and 0.050 inch.

12. The paper-making machine of claim 1, wherein said holes are disposed in a pattern in said sheet.

* * * * *